US005259721A

United States Patent [19]

Sato et al.

[11] Patent Number: 5,259,721

[45] Date of Patent: * Nov. 9, 1993

[54] APPARATUS FOR TRANSPORTING/MOUNTING A BUILDING MATERIAL

[75] Inventors: Tadao Sato; Kiyoshi Kubo; Yukio Nozaki; Yasunobu Miyazaki, all of Tokyo; Yasuo Tomokane, Kyoto; Atsutomo Komine; Hidetaka Suzuki, both of Kanagawa, all of Japan

[73] Assignees: Kajima Corporation; Kabushiki Kaisha Komatsu Seisakusho, Japan

[ * ] Notice: The portion of the term of this patent subsequent to Jul. 9, 2008 has been disclaimed.

[21] Appl. No.: 427,588

[22] Filed: Oct. 26, 1989

[30] Foreign Application Priority Data

Oct. 26, 1988 [JP] Japan ..... 63-268284

[51] Int. Cl.[5] ..... B66F 11/00

[52] U.S. Cl. ..... 414/620; 414/11; 414/663; 180/211

[58] Field of Search ..... 414/607, 618, 619, 620, 414/639, 640, 641, 642, 662, 663, 728, 742, 10, 11; 180/15, 16, 211, 213, 214; 901/30

[56] References Cited

U.S. PATENT DOCUMENTS

| | | | |
|---|---|---|---|
| 2,618,396 | 11/1952 | Belt | 180/211 X |
| 2,756,883 | 7/1956 | Schreck | 414/620 X |
| 2,875,852 | 3/1959 | Morrell | 180/211 X |
| 3,409,158 | 11/1968 | Lull | 414/11 X |
| 3,598,263 | 8/1971 | Ehmke | 414/620 |
| 3,734,328 | 5/1973 | Dalglish | 414/620 |
| 3,888,362 | 6/1975 | Fletcher et al. | 414/620 |
| 3,998,288 | 12/1976 | Aoki | 180/211 |
| 4,027,802 | 6/1977 | Reynolds | 414/11 |
| 4,604,787 | 8/1986 | Silvers | 901/30 X |
| 4,723,353 | 2/1988 | Monforte | 901/30 X |
| 4,810,151 | 3/1989 | Shern | 414/11 |
| 4,884,938 | 12/1989 | Fujita et al. | 414/11 X |
| 4,913,617 | 4/1990 | Nicholson | 901/30 X |

FOREIGN PATENT DOCUMENTS

| | | | |
|---|---|---|---|
| 3010482 | 9/1981 | Fed. Rep. of Germany | 414/11 |
| 2514738 | 4/1983 | France | 414/620 |
| 0149166 | 11/1979 | Japan | 414/663 |
| 1333567 | 8/1987 | U.S.S.R. | 414/11 |

*Primary Examiner*—Michael S. Huppert
*Assistant Examiner*—James T. Eller, Jr.
*Attorney, Agent, or Firm*—Ronald P. Kananen

[57] ABSTRACT

In order to safely transport a building material to its mounting area of a building body and to temporarily hold the same until it is firmly mounted on the mounting area on the building site, according to the present invention, there is provided, an apparatus for transporting-/mounting a building material including a self-propelled vehicle body provided with a steering/driving device, the vehicle body assuming a substantially L-shaped form constructed of an upright main body and a pair of lower frames which are parallelly spaced apart from each other and horizontally extend from opposite sides of a lower portion of the main body; an elevator unit movably mounted on a vertical side portion of the main body so as to be vertically movable along the vertical side portion of the main body; a first frame horizontally extending forward from a vertical side of the elevator unit, the first frame having its base end mounted on the elevator unit so as to be horizontally movable in a horizontal plane; a second frame slidably mounted in the first frame so as to be extended therefrom and retracted therein in a longitudinal direction of the first frame; and a support for supporting a building material, the support being so mounted on a front end of the second frame as to be vertically swingable and as to be rotatable on an axis perpendicular to a plane of the building material having been supported by the support.

6 Claims, 11 Drawing Sheets

APPARATUS FOR TRANSPORTING/MOUNTING A BUILDING MATERIAL

BACKGROUND OF THE INVENTION

1. Field of the Invention

The present invention relates to an apparatus for transporting a building material, for example such as: interior surfacing materials such as beam members, column members and like surfacing materials; and panel-like wall members such as PC boards, ALC boards, glass plates, framed-glass plates, glass-plate sashes and the like, to a predetermined mounting area of a building body and the like to mount the building material on the mounting area thereof.

2. Description of the Prior Art

Hitherto, on a building site of a building body, the building material such as the interior surfacing materials and the panel-like wall members such as PC boards, ALC boards and the like (hereinafter simply referred to as the building material) which are heavy articles are mounted on an exterior and an interior surface of the building body to serve as exterior walls and interior walls of the building body. However, since the building materials described above are considerably heavy articles, it is very cumbersome for building workers to transport and mount them on the building site.

For example, in case that the building materials are mounted on the exterior surface of the building body to serve as exterior surfacing members of the building body, in general, a great number of the building materials are piled up on the ground of the building site. Then, they are craned up to their mounting areas of the building body by means of cranes and the like so as to be mounted on the mounting areas of the building body. In some cases, a great number of the building materials are lifted to a predetermined floor of the building body by means of cranes or working elevators, and temporarily piled up on the floor. After that, each of the building materials is moved out of the interior of the building body through an opening portion of the building body so as to be mounted on the exterior surface of the building body.

On the other hand, in case that the building materials are mounted on the interior surface of the building body to serve as the interior surfacing members of the building body, a great number of the building materials are lifted to a predetermined floor of the building body, and temporarily piled up on the floor. After that, each of the building materials is mounted on the interior surface of the building body to serve as an interior surfacing member.

In case that the building materials are craned up to the predetermined floor exterior surface of the building body by means of the crane so as to be mounted on the exterior surface, only one of the building materials is craned up to the predetermined floor exterior surface each time the crane is operated. Consequently, in case that a great number of the building materials must be craned up to a considerably high exterior surface of the building body and mounted on the exterior surface, it is required for the building workers to put up a suitable scaffolding around the building body at no small cost of time and labor. Furthermore, the craning-up operation of the building materials conducted at this time by the crane takes too much time to considerably impair working efficiency in building operation. In addition, in such craning-up operation: there is a fear that the building materials interfere with other building materials and the building body itself to damage them; and there is another fear that the building materials fall on the ground by mistake.

Further, hitherto, in case that a great number of the building materials are transported to a predetermined floor of the building body so as to be mounted on predetermined mounting areas of the floor, workers on the building site transport them by hands to the predetermined mounting areas, and temporarily hold them at the predetermined areas during mounting operation of the building materials. However, such manual transporting and manual mounting operation conducted by the workers are very troublesome and dangerous.

SUMMARY OF THE INVENTION

Under such circumstances, the present invention was made. Consequently, it is an object of the present invention to provide an apparatus for transporting/mounting building materials, which apparatus enables workers on the building site of a building body to safely transport the building materials to a predetermined mounting area of the building body so as to mount the building materials on the mounting area, the building materials being temporarily held by the apparatus at the mounting area until they are mounted on the area.

According to a first embodiment of the present invention, the above object of the present invention is accomplished by providing:

An apparatus for transporting/mounting a building material comprising:

a self-propelled vehicle body provided with a steering/driving means, the vehicle body assuming a substantially L-shaped form constructed of: an upright main body; and a pair of lower frames which are parallelly spaced apart from each other and horizontally extend from opposite sides of a lower portion of the upright main body of the vehicle body;

an elevator unit movably mounted on a vertical side portion of the upright main body of the vehicle body so as to be vertically movable along the vertical side portion of the upright main body of the vehicle body;

a first frame means horizontally extending forward from a vertical side portion of the elevator unit, the first frame means having its base-end portion mounted on the elevator unit so as to be horizontally movable in a horizontal plane;

a second frame means slidably mounted in the first frame means so as to be extended therefrom and retracted therein in a longitudinal direction of the first frame means; and a supporting means for supporting a building material, the supporting means being so mounted on a front-end portion of the second frame means as to be vertically swingable and as to be rotatable on an axis perpendicular to a plane in which the building material having been supported by the supporting means lies.

Further, according to a second embodiment of the present invention, the above object of the present invention is accomplished by providing:

The apparatus for transporting/mounting the panel-like building material of the first embodiment of the present invention, wherein:

the supporting means comprises:

an adapter plate fixedly mounted on a front-end portion of a vertical mounting plate which is mounted on a front-end portion of the second frame means through a pivot so as to be swingable in a vertical plane;

a guide ring fixedly mounted on an outer peripheral surface of a side portion of the adapter plate;

a swivel plate provided with a ring-like projection in its rear surface, the ring-like projection being rotatably mounted on an inner peripheral surface of the guide ring through a plurality of balls so as to be adjacent to a front surface of the adapter plate, the swivel plate being connected with a swivel motor fixedly mounted on the adapter plate;

a supporting plate mounted on the swivel plate through bracket means and a pivot so as to be swingable in a horizontal plane relative to the swivel plate, the bracket means being fixed to a substantially central portion of a front surface of the swivel plate, the pivot being mounted on the bracket means, the supporting plate being provided with a plurality of through-holes for supporting the building materials; and a control means for swingably driving the supporting plate in a horizontal plain so as to position the supporting plate.

In the above first embodiment of the apparatus of the present invention for transporting/mounting the building material, it is possible: to vertically move the supporting means by vertically moving the elevator unit provided with the first frame means along the upright main body of the vehicle body of the apparatus; to horizontally move the supporting means by horizontally moving the first frame means along the elevator unit; to move the supporting means back and forth by moving the second frame means back and forth in a horizontal plane along the first frame means; to position the supporting means in a horizontal and a vertical position thereof by swinging the adapter plate in a vertical plain relative to the second frame means; and to rotate the supporting means by rotating the swivel plate relative to the adapter plate.

Consequently, in the apparatus of the present invention, it is possible for the supporting means or plate for supporting the building material to move vertically, to move horizontally, to move back and forth, to swing in a vertical plane and to rotate. Therefore, in handling operation of the apparatus of the present invention, first of all, the supporting plate of the apparatus is positioned in an area immediately above at least one of the building materials having piled up on the ground or floor, so as to be oppositely disposed from the building material, and then supports the building material. After that, the support plate is moved upward while rotated in a horizontal plane to rotate the building material by an angle of 90°, so that the building material is retracted into the vehicle body of the apparatus and held in a position on the lower frames of the vehicle body during its transportation by the apparatus. As described above, it is possible for the apparatus of the present invention to transport the building material to a predetermined mounting area of the building material safely and surely. In addition, during transportation of the building material, since the vehicle body of the apparatus assumes the substantially L-shaped form, the vehicle body of the apparatus is excellent in stability, and therefore there is no fear that the vehicle body of the apparatus falls down even when the apparatus carries a considerably heavy building material.

After the apparatus reaches the predetermined mounting area of the building material, the supporting plate of the apparatus is moved upward and forward to take a vertical position so that the building material supported by the supporting plate is also moved upward and forward to take a vertical position, to enable the building material to extend forward from an opening portion of a building body. Under such circumstances, the supporting plate is moved rearward so that the building material is pressed against an exterior surface of the building body.

As described above, it is possible for the apparatus of the present invention to hold the building material in its mounting area until the building material is mounted on the exterior surface of the building body, which enables an operator of the apparatus to easily mount the building material constituting an exterior surfacing member of the building body.

The above object, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

The present invention will be described hereinbelow in detail, by way of example, with reference to the accompanying drawings illustrating preferred embodiments of the present invention.

First of all, a first embodiment of the present invention will be described in construction with reference to FIGS. 1 to 7.

Figure 1:
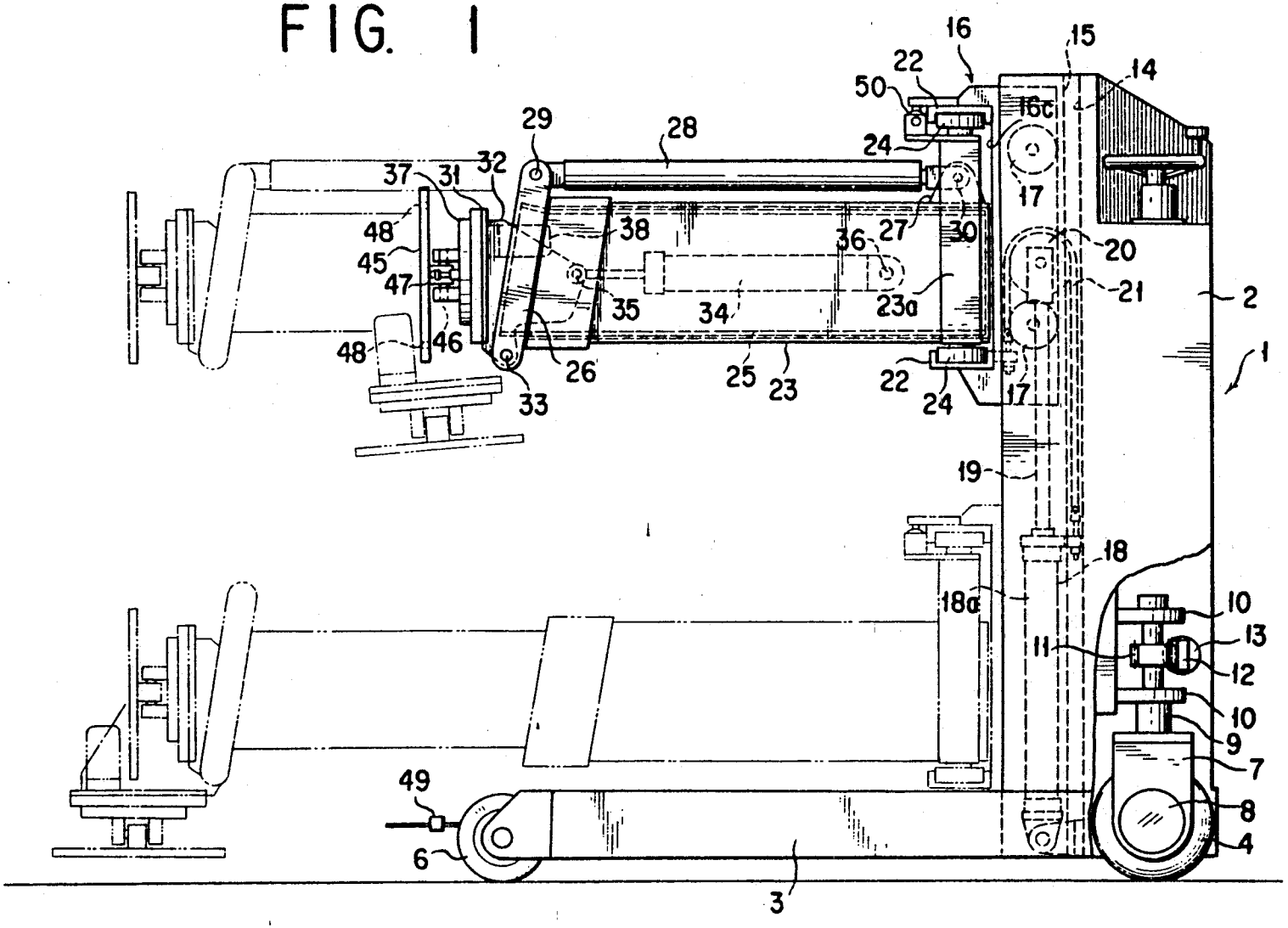
FIGS. 1, 2 and 3 are a schematic front view, a schematic plan view and a schematic side view of an embodiment of the apparatus of the present invention, respectively.
Figure 3:
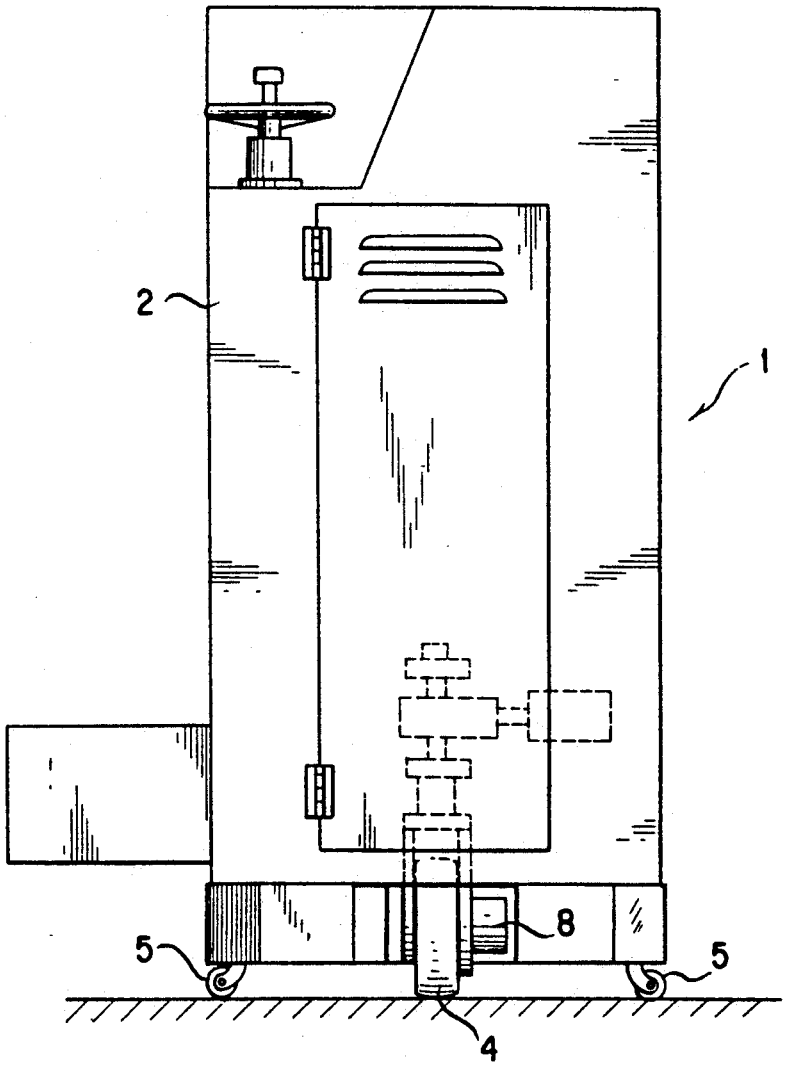

As shown in FIG. 1, an apparatus of the present invention for transporting/mounting a panel-like wall comprises the vehicle body 1 which assumes a substantially L-shaped form constructed of: an upright main body 2; and a pair of lower frames 3 which are parallelly spaced apart from each other and horizontally extend forward from opposite sides of a lower portion of the upright main body 2 of the vehicle body 1. In a central portion of a lower part of the upright main body 2 of the vehicle body 1 is provided a steering/driving wheel 4 serving as a steering/driving means of the apparatus. The wheel 4 is rotatable on its vertical axis. If necessary, a pair of auxiliary casters 5 are additionally provided in opposite sides of the lower part of the upright main body 2 of the vehicle body 1, as shown in FIG. 3, the casters 5 being freely rotatable on their vertical axes. In addition, a front wheel 6 is rotatably mounted on a front-end portion of each of the lower frames 3 of the vehicle body 1. Incidentally, as shown in FIG. 3, an operator stand 80 may be provided in a right-side or a left side of a lower portion of the main body 2 of the vehicle body 1 as indicated in phantom lines.

Figure 4:
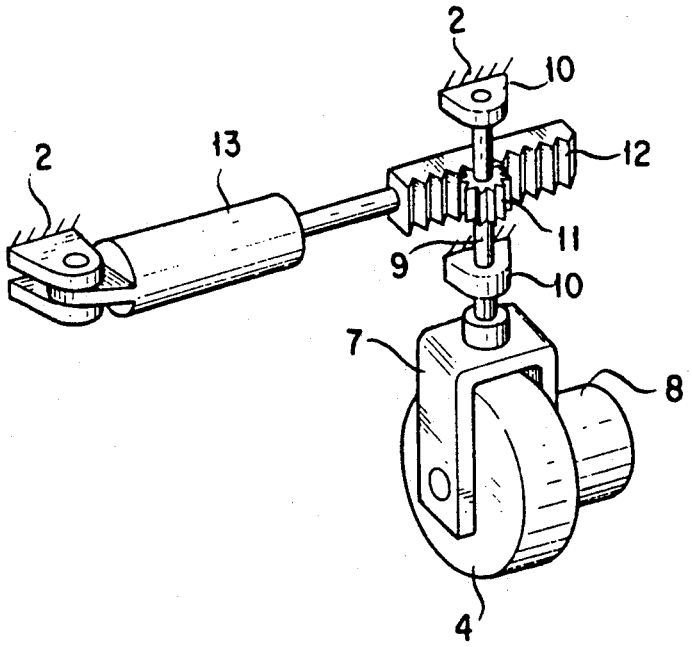
FIG. 4 is an enlarged perspective view of a driving-wheel mounting portion of the apparatus of the present invention.

For example, as shown in FIG. 4, the steering/driving wheel 4 is rotatably mounted in an inverted U-shaped bracket 7, while rotatably driven by a traveling motor 8 fixedly mounted in the bracket 7. A longitudinal shaft 9 so provided in a central portion of an upper end surface of the bracket 7 as to extend upward from the central portion is rotatably mounted in a pair of through-holes of a pair of supporting brackets 10 which are so provided in the main body 2 of the vehicle body 1 as to be vertically spaced apart from each other. For example, as shown in FIG. 4, a pinion 11 is fixedly mounted on the longitudinal shaft 9 while meshed with a rack 12 which is reciprocally driven in a horizontal plane by a steering cylinder 13 so that the vehicle body 2 is steered. Namely, in steering operation, the longitudinal shaft 9 of the steering/driving wheel 4 is rotatably driven on its vertical axis together with the bracket 7 relative to the main body 2 of the vehicle body 1.

Incidentally, in steering operation, it is also possible to rotatably drive the longitudinal shaft 9 of the steering/driving wheel 4 by a suitable torque actuator or hydraulic motor.

Figure 2:
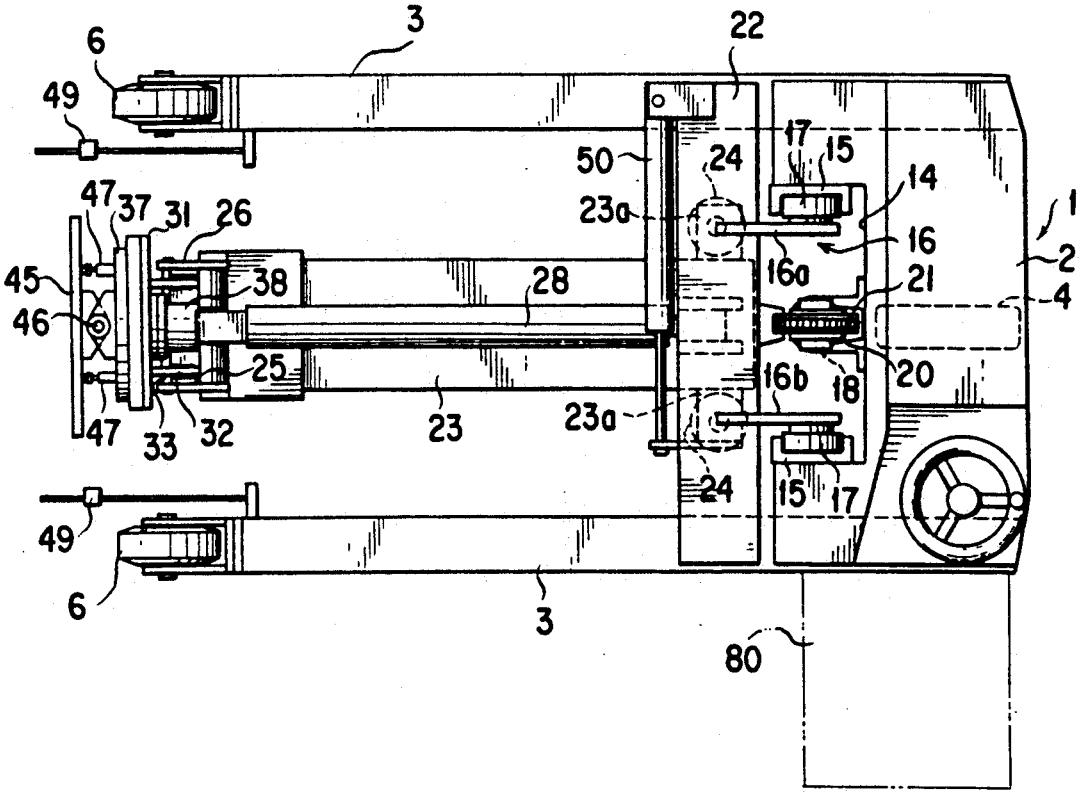

In plan view of the apparatus of the present invention shown in FIG. 2, the main body 2 of the vehicle body 1 of the apparatus is provided with a concave portion 14 assuming a substantially C-shaped form having its opening disposed in the front of the vehicle body 1. On opposite sides of the concave portion 14 of the main body 2 are provided a pair of vertical guide rails 15 which are oppositely disposed from each other as shown in FIG. 2. In the vertical guide rails 15 are slidably mounted a pair of rollers 17 which are rotatably mounted on, for example a pair of vertical plates **16*a*, 16*b* constituting an elevator element 16. As shown in FIG. 1, a vertical positioning cylinder 18 is provided with a piston rod 19, while so mounted in the concave portion 14 of the main body 2 of the vehicle body 1 as to have its base-end portion connected to a lower portion of the main body 2 and as to have a top-end portion of the piston rod thereof disposed between the vertical plates 16*a*, 16*b* of the elevator element 16. On the top-end portion of the piston rod 19 of the positioning cylinder 18 is rotatably mounted a sprocket 20. A chain 21 runs round the sprocket 20 and has an end thereof fixed to a cylinder body 18*a* of the positioning cylinder 18, and has the other end thereof fixed to the elevator element 16, whereby the elevator element 16 is moved up and down along the vertical guide rails 15 when the piston rod 19 of the positioning cylinder 18** is extended and retracted.

As shown in FIG. 1, the elevator element 16 is provided with a recessed portion **16*c* assuming a substantially C-shaped form which opens in the front of the vehicle body 1. Each of a pair of horizontal guide rails 22 is fixedly mounted on an upper and a lower inner surface of the recessed portion 16*c* of the elevator element 16 so as to be oppositely disposed from each other, as shown in FIG. 1. On the other hand, Each of a pair of rollers 24 is rotatably mounted on an upper and a lower surface of a mounting segment 23*a* of a sleeve-like first frame 23, which segment 23*a* is disposed between the horizontal guide rails 22 so that the rollers 24 are rotatably received in the horizontal guide rails 22. Namely, as shown in FIG. 1, A base portion of a sleeve-like first frame 23 is disposed between the rollers 24 rotatably mounted on the mounting segment 23*a*. Consequently, the first frame 23 is horizontally moved relative to the main body 2 of the vehicle body 1 when the mounting segment 23*a* thereof is horizontally moved along the guide rails 22. As shown in FIG. 1, the first frame 23 extends forward from the main body 2 of the vehicle body 1. As shown in FIG. 2, a widthwise-positioning cylinder 50 is horizontally mounted between one of the horizontal guide rails 22 (i.e., an upper one 22 in the embodiment shown in FIG. 2) and the mounting segment 23*a* of the first frame 23**.

In the first frame 23 is slidably mounted a sleeve-like second frame 25 which is extended from and retracted into the first frame 23 so as to be moved forward and rearward relative to the first frame 23. As shown in FIG. 1, a pair of elongated plates 26 are fixedly mounted on a front-end portion of the second frame 25. Opposite ends of a longitudinally-positioning cylinder 28 are rotatably mounted on a pair of pins 29, 30, the pin 29 being mounted on upper-end portions of the elongated plates 26, and the other pin 30 being mounted on upper-end portions of a pair of brackets 27 fixed to an upper surface of the base portion of the first frame 23. Consequently, when the longitudinally-positioning cylinder 28 is actuated, the second frame 25 is slidably extended and retracted along the first frame 23.

On the front-end portion of the second frame 25 is further mounted an adapter plate 31 to a back surface of which are fixed a pair of vertical mounting plates 32 which are rotatably mounted on lower portions of the elongated plates 26 through a horizontal pin 33. On the other hand, as shown in FIG. 1, each of a pair of angularly-positioning cylinders 34 for angularly positioning each of the vertical mounting plates 32 is rotatably mounted on a pair of pins 35, 36, the pin 35 being mounted on a rear-end portion of the vertical mounting plate 32, and the other pin 36 being mounted on a rear portion of the second frame 25. On the adapter plate 31 is rotatably mounted a swivel plate 37 which is so driven by a swivel motor 38 as to rotate on an axis perpendicular to the adapter plate 31.

Figure 5:
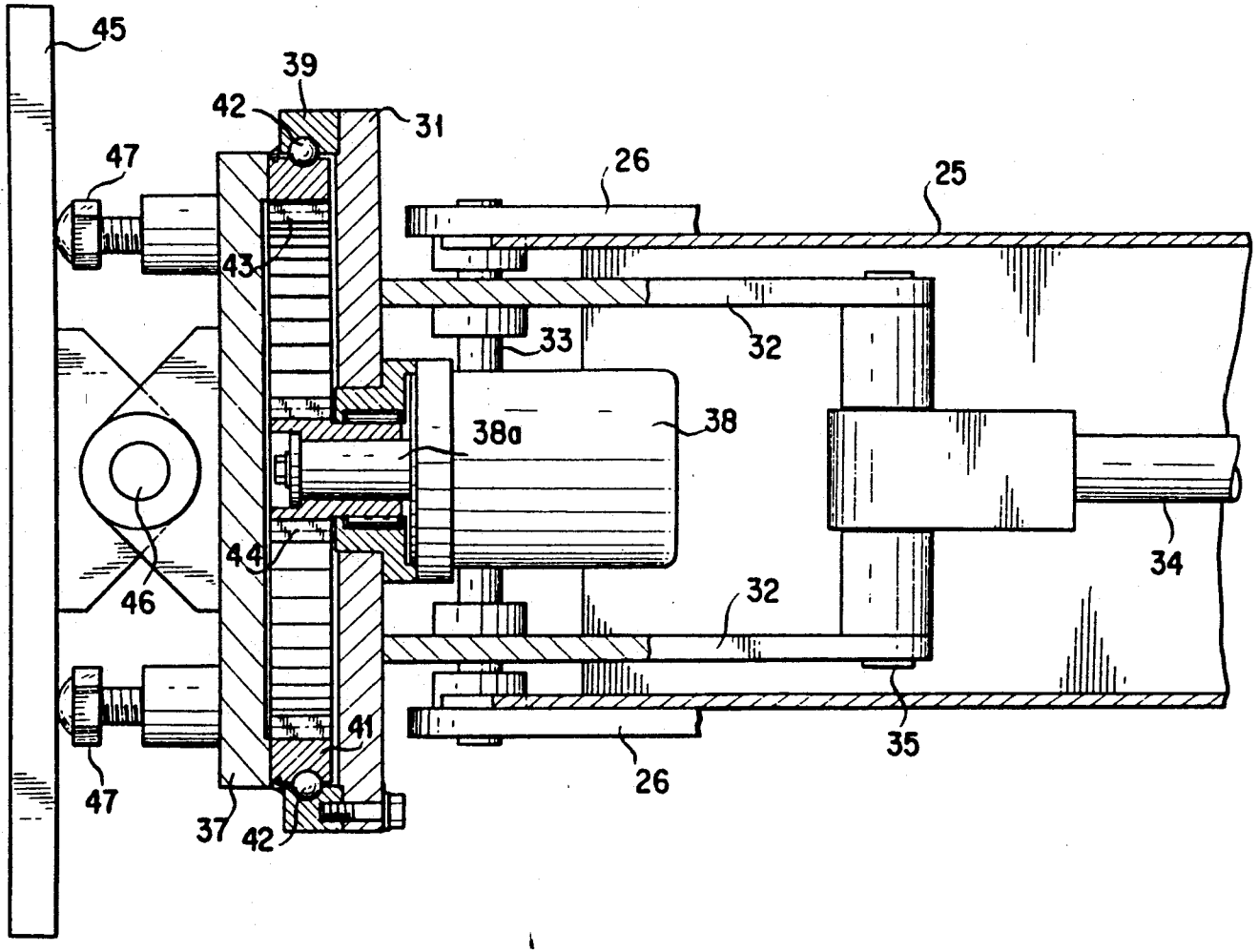
FIG. 5 is a cross-sectional view of the apparatus of the present invention, illustrating a swivel portion and a supporting portion of a front end of a second frame of the apparatus.
Figure 6:
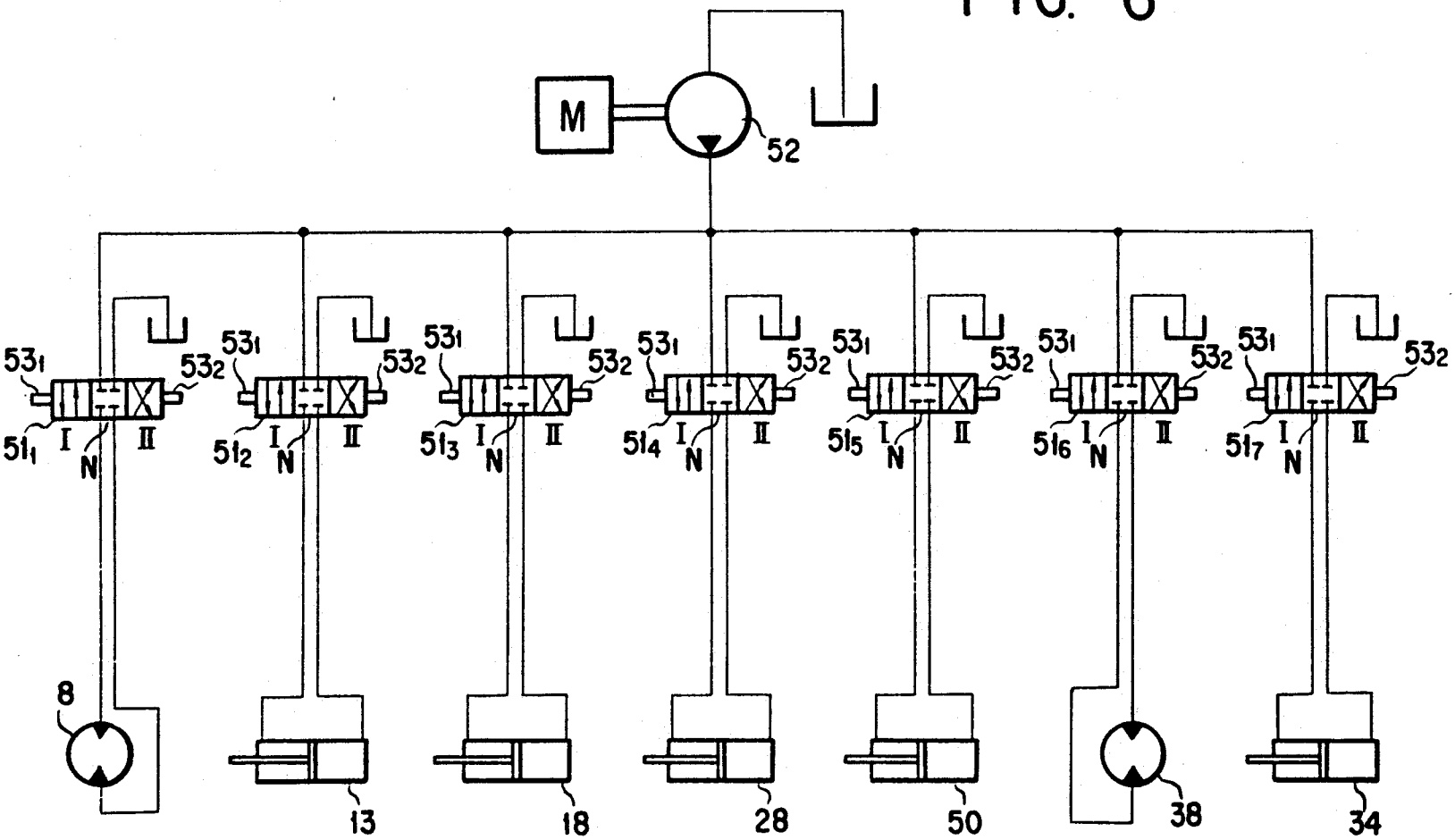
FIG. 6 is a hydraulic circuit for actuators employed in the apparatus of the present invention.

Namely, as shown in FIG. 5, a guide ring 39 is fixedly mounted on the adapter plate 31 through a plurality of bolts 40. On the other hand, a ring-like projection 41 is fixed to the swivel plate 37, while rotatably mounted in the guide ring 39 through a plurality of balls 42. A ring gear 43 is formed in an inner peripheral surface of the ring-like projection 41. To a power output shaft **38*a* of the swivel motor 38 is fixed a pinion 44 which meshes with the ring gear 43. Consequently, when the swivel motor 38 is actuated, the swivel plate 37 is rotatably driven by the motor 38. Incidentally, the swivel motor 38 is housed in the second frame 25**.

It is also possible to directly drive the swivel plate 37 by the swivel motor 38 without employing the ring gear 43, the motor 38 having its power output shaft **38*a* directly connected to a center of the swivel plate 37**.

On the swivel plate 37 is swingably mounted a supporting plate 45 through a pin 46 and a pair of brackets **46*a*, 46*b*. On the other hand, a pair of positioning bolts 47 are mounted on the swivel plate 37 so as to extend forward a length of each of which bolts 47 is adjustable, the pair of the positioning bolts 47 lying in a plane perpendicular to the pin 46 and sandwiching the pin 46 therebetween as shown in FIG. 5. A front end of each of the positioning bolts 47 abuts on a rear surface of the supporting plate 45 to regulate a swinging angle of the supporting plate 45 relative to the swivel plate 37. The supporting plate 45 is provided with a plurality of through-holes 48**.

Since the apparatus of the present invention has the above construction, it is possible for the supporting plate 45 to move up/down and back/forth relative to the vehicle body 1 of the apparatus. In addition, it is also possible for the supporting plate 45: to swing in a vertical plane to a vertical and a horizontal position thereof; to rotate; and to slightly swing in a horizontal plane.

As shown in FIG. 1, a contact sensor 49 is mounted on a front-end portion of each of the lower frames 3 of the vehicle body 1 so as to extend forward.

To each of actuators of the apparatus of the present invention such as the traveling motor 8, steering cylinder 13, vertical positioning cylinder 18, longitudinally-positioning cylinder 28, widthwise-positioning cylinder 50, swivel motor 38 and the angularly-positioning cylinder 34 is supplied a pressure oil discharged from a hydraulic pump 52 through a first to a seventh control valves $51_1$ to $51_7$. Each of the above control valves $51_1$ to $51_7$ is constructed of a solenoid operated four-way/-three-position valve which is normally positioned in its N (neutral) position, and moved into a first pressure oil supplying position I or a second pressure oil supplying position II when a first solenoid $53_1$ or a second solenoid $53_2$ is energized. Each of the solenoids $53_1$, $53_2$ is controlled by a controller.

Figure 7:
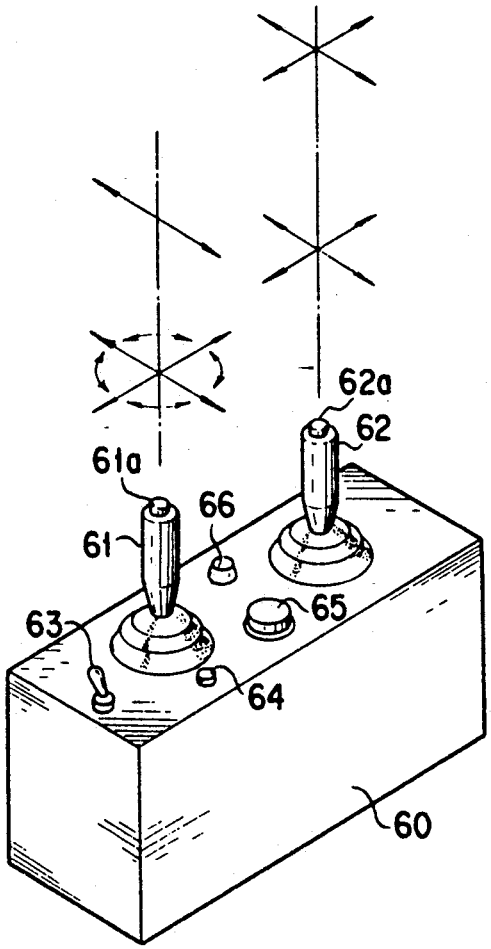
FIG. 7 is a schematic perspective view of an embodiment of a controller for controlling the actuators employed in the apparatus of the present invention.

For example, as shown in FIG. 7, the above-mentioned controller is comprises a box 60 on which a first lever 61 and a second lever 62 are pivotally mounted so as to be able to swing to and fro in a longitudinal and a width direction thereof. Further provided in controller are: a main switch 63; a pilot lamp 64; an emergency-stop button 65; and an operation button 66. In operation, when the first lever 61 is swung forward, the second solenoid $53_1$ of the first control valve $51_1$ is energized so that the traveling motor 8 rotates in a normal direction thereof, whereby the vehicle body 1 of the apparatus of the present invention moves forward. On the other hand, when the first lever 61 is swung rearward, the second solenoid $53_2$ of the first control valve $51_1$ is energized so that the traveling motor 8 rotates in a direction counter to the above normal direction, whereby the vehicle body 1 moves rearward. When the first lever 61 is swung forward and leftward, the first solenoids $53_1$ of the first $51_1$ and the second $51_2$ control valves are energized so that the traveling motor 8 rotates in the normal direction. At this time, the steering cylinder 13 is extended to steer the driving wheel 4 to the left so that the vehicle body 1 moves forward and leftward.

In a similar manner to the above, when the first lever 61 is swung rearward/leftward, forward/rightward and rearward/rightward, the vehicle body 1 moves rearward/leftward, forward/rightward and rearward/-rightward, respectively.

On the other hand, when the first lever 61 is swung back and forth while depressed at its button **61*a*, the first solenoid $53_1$ or the second solenoid $53_2$ of the third control valve $51_3$ is energized so that the vertical positioning cylinder 18 is extended and retracted to move the supporting plate 45 up and down. When the second lever 62 is swung back and forth, the first $53_1$ and the second $53_2$ solenoids of the fourth control valve $51_4$ are energized so that the longitudinally-positioning cylinder 28 is extended and retracted to move the supporting plate 45 back and forth relative to the vehicle body 1**.

In addition, when the second lever 62 is swung in the width direction of the box 60, the first $53_1$ and the second $53_2$ solenoids of the fifth control valve $51_5$ are energized so that the widthwise-positioning cylinder 50 is extended and retracted to move the supporting plate 45 widthwise relative to the vehicle body 1.

When the second lever 62 is swung back and forth while depressed at its button **62*a*, the first $53_1$ and the second $53_2$ solenoids of the seventh control valve $51_7$ are energized so that the angularly-positioning cylinder 34 is extended and retracted to swing the supporting plate 45** in a vertical plane.

In a similar manner to the above, when the second lever 62 is swung widthwise, the first $53_1$ and the second $53_2$ solenoids of the sixth control valve $51_6$ are energized so that the swivel motor 38 rotates in the normal direction and the direction counter to the normal direction to rotate the supporting plate 45 in its normal direction and a direction counter thereto through the swivel plate 37.

In addition to the above two-lever type construction of the controller shown in FIG. 7, the controller may assume any other construction form, for example such as one provided with a number of levers for controlling a number of operations, one electrically controlled such as a remote control unit or a radio control unit.

Now, handling operation of the building material will be described hereinbelow in detail.

Figure 8A:
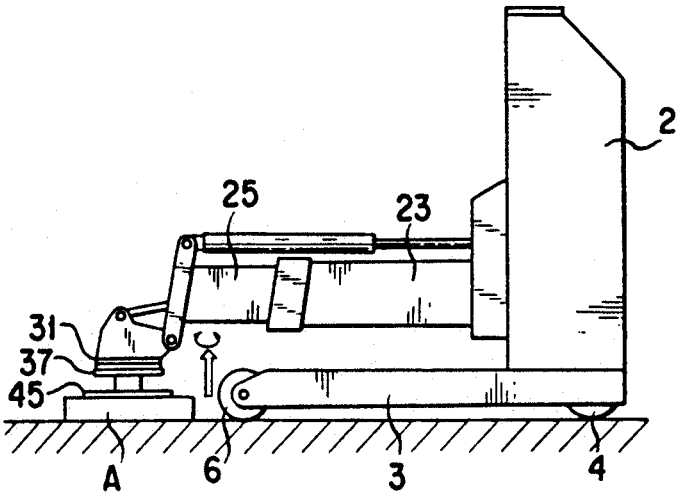
FIGS. 8A to 8E are view illustrating operation of the apparatus of the present invention shown in FIG. 1.

As shown in FIG. 8A, first of all, the supporting plate 45 is positioned at its horizontal position, while moved forward relative to the vehicle body 1. Then, the supporting plate 45 is lowered so as to be brought into contact with a top one of building materials "A" which are piled up on the ground and provided with a plurality of stud bolts, so that the stud bolts provided in the top building material "A" are received in the through-holes 48 of the supporting plate 45 and then threadably engaged with nuts, whereby the building material "A" is fixed to the supporting plate 45.

In this case, since the building materials "A" are so piled up on the ground as to have their longitudinal axes oriented toward a direction perpendicular to a traveling direction of the vehicle body 1, the building materials "A" extend widthwise beyond the vehicle body 1 on the ground.

Figure 8B:
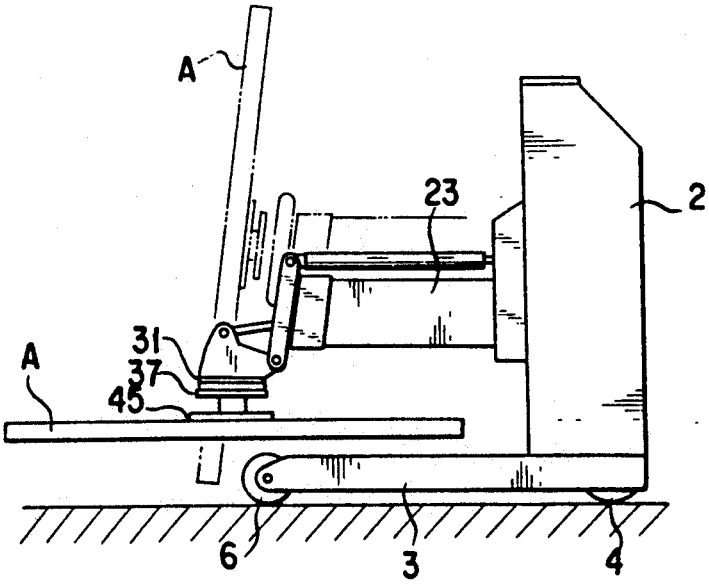

As shown in FIG. 8B, in handling operation of the building material "A", the supporting plate 45 is slightly lifted while rotated together with the swivel plate 37 by an angle of 90° by means of the swivel motor 38, so that the building material "A" fixed to the supporting plate 45 has its longitudinal axis aligned with the traveling direction of the vehicle body 1, whereby the building material "A" fixed to the supporting plate 45 is prevented from extending widthwise beyond the vehicle body 1. After that, the second frame 25 of the vehicle body 1 is retracted to slightly move the supporting plate 45 rearward so that the building material "A" is held in a horizontal position in the vehicle body 1. Incidentally, in order to hold the building material "A" in a position indicated in phantom lines in FIG. 8B, the first frame 23 of the vehicle body 1 is moved upward, and then the supporting plate 45 is swung upward to hold the building material "A" in a vertical position.

Figure 8C:
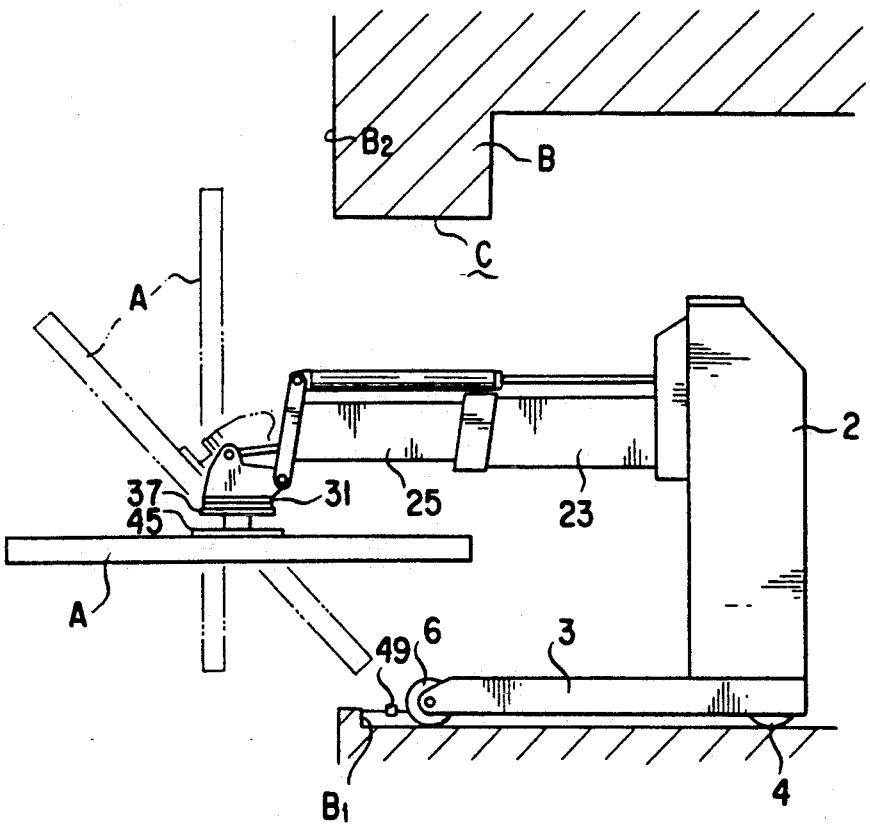

Under such circumstances, as shown in FIG. 8C, the vehicle body 1 travels forward so that the building material "A" fixed to the supporting plate 45 of the vehicle body 1 enters an opening portion "C" of a building body "B". At this time, when at least on of the contact sensors 49 of the vehicle body 1 touches a lower part $B_1$ of the opening portion "C" of the building body "B", the vehicle body 1 automatically stops. Namely, the contact sensor 49 brought into contact with the lower part $B_1$ issues a signal to the first solenoid $53_1$ of the first control valve $51_1$ to de-energize the same so that the first control valve $51_1$ is held in its neutral position.

Since the vehicle body 1 of the apparatus of the present invention had the above construction excellent in stability, there is no fear that the vehicle body 1 carrying the building material "A" tilts forward in traveling under the influence of the weight of the building material "A". Namely, the vehicle body 1 is constructed of the main body 2 and the lower frames 3 so as to assume a substantially L-shaped form in its longitudinal section, while supported by the steering/driving wheel 4 and the front wheels 6 with a long wheel base. In addition, the building material "A" retracts to a space above the lower frames 3 of the vehicle body 1 and is held in the space. Consequently, it is possible to support an overturning moment of the vehicle body 1 by means of the front wheels 6 and the weight of the main body 2 of the vehicle body 1, which overturning moment is caused by the building material "A" fixed to the supporting plate 45 of the vehicle body 1. As is clear from the above description, the vehicle body 1 of the apparatus of the present invention is excellent in stability.

In mounting operation of the building material "A", after the vehicle body 1 stops as described above, the first frame 23 of the vehicle body 1 is lifted, while the second frame 25 is extended forward, so that the supporting plate 45 is moved upward and forward. At this time, the adapter plate 31 is swung in a vertical plane to swing the supporting plate 45 upward in a vertical plane, so that the building material "A" is moved out of the building body "B" through the opening portion "C" of the building body "B", and held in a vertical position.

After that, the second frame 25 of the vehicle body 1 is retracted so that the supporting plate 45 is moved rearward relative to the vehicle body 1, whereby the building material "A" fixed to the supporting plate 45 abuts on an exterior surface $B_2$ of the building body "B". Then, the first frame 23 is moved vertically and widthwise to move the supporting plate 45 vertically and widthwise so that the building material "A" fixed to the supporting plate 45 is positioned at a predetermined mounting area of the exterior surface $B_2$ of the building body "B".

Figure 8D:
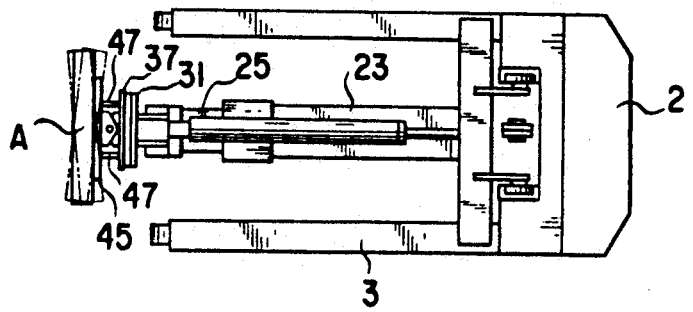

As shown in FIG. 8D, in mounting operation of the building material "A" on the exterior surface $B_2$ of the building body "B", since it is not possible for the building material "A" to closely abut on the exterior surface $B_2$ of the building body "B" when a longitudinal center line of the vehicle body 1 is not perpendicular to the exterior surface $B_2$ of the building body "B", it is necessary to adjust the positioning bolts 47 so as to suitably tilt the supporting plate 45 in case that the longitudinal center line of the vehicle body 1 is not perpendicular to the exterior surface $B_2$ of the building body "B". Namely, in case that the longitudinal center line of the vehicle body 1 is not perpendicular to the exterior surface $B_2$ of the building body "B", it is possible for the building material "A" to closely abut on the exterior surface $B_2$ of the building body "B" by suitably adjusting the positioning bolts 47 provided in the swivel plate 37 shown in FIG. 5.

Under such circumstances, the building material "A" is fixedly mounted on the exterior surface $B_2$ of the building body "B" by a suitable fastening means. After completion of mounting operation of the building material "A" on the exterior surface $B_2$ of the building body "B", the nuts having been threadably engaged with the stud bolts of the building material "A" for fixing the building material "A" to the supporting plate 45 are loosened so that the building material "A" is separated from the supporting plate 45 of the vehicle body 1.

Figure 8E:
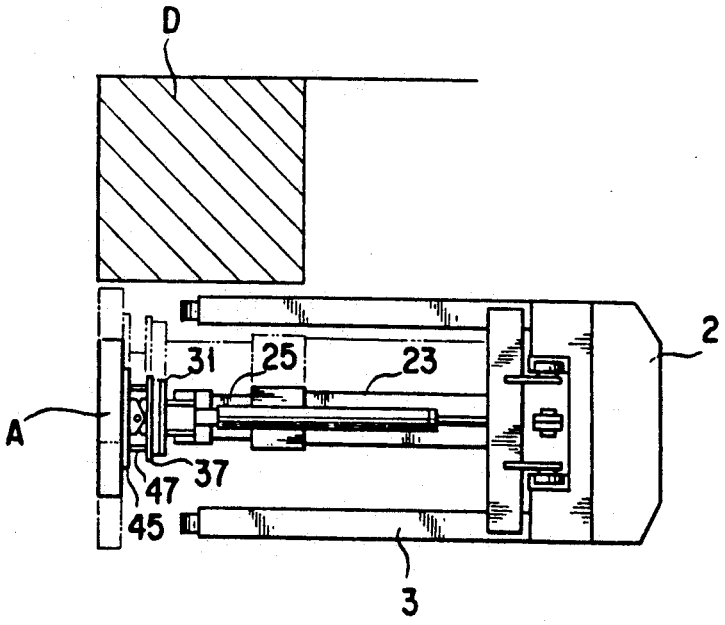

As shown in FIG. 8E, in case that the building material "A" is mounted on a corner portion "D" of the building body "B", the first frame 23 of the vehicle body 1 is suitably moved widthwise by means of the widthwise-positioning cylinder 50 to move the supporting plate 45 widthwise so that the building material "A" fixed to the supporting plate 45 is easily positioned at a predetermined mounting area of the building body "B".

In the above embodiment of the vehicle body 1 of the present invention, the building material "A" is fixed to the supporting plate 45 of the vehicle body 1 by means of the stud bolts provided in the building material "A" and the nuts threadably engaged with the stud bolts through the supporting plate 45. In addition to the above construction, it is also possible for the vehicle body 1 to employ any other suitable mechanism for fixing the building material "A" to the supporting plate 45, such as a vacuum mechanism, a clamp mechanism and the like. Furthermore, it is also possible for the supporting plate 45 to have various kinds of clamping attachments detachably mounted thereon so as to make it possible to transport and mount various kinds of the building materials.

Figure 9:
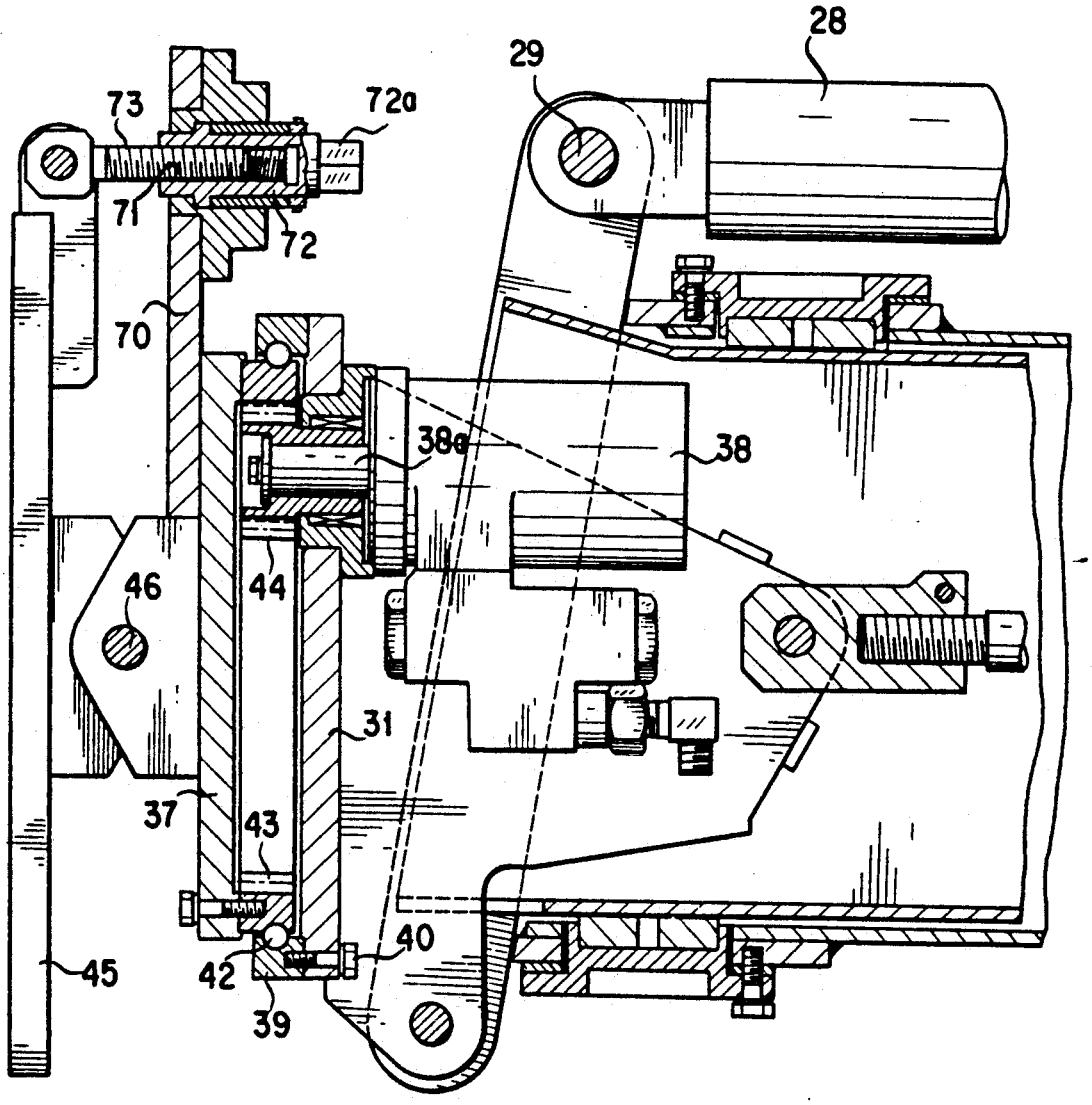
FIG. 9 is a view similar to FIG. 5, illustrating another embodiments of the swivel portion and the supporting portion of the front end of the second frame of the apparatus of the present invention.

In addition, as shown in FIG. 9, it is possible for the vehicle body 1 to provide a mounting-plate member 70 in the swivel plate 37. In the mounting-plate member 70 is rotatably mounted a sleeve-like nut member 72 having a threaded hole 71, the nut member 72 being prevented from moving in its longitudinal direction. A threaded rod 73 is threadably engaged with the threaded hole 71 of the sleeve-like nut member 72, while connected with the supporting plate 45 of the vehicle body 1. A rear-end portion of the nut member 72 is formed into a square projection 72*a* assuming a square shape in cross section. The square projection 72*a* of the nut member 72 is rotatably driven by means of a ratchet wrench so that the supporting plate 45 is tilted, whereby the building material "A" fixed to the supporting plate 45 is brought into a close contact with the exterior surface $B_2$ or an interior surface of the building body "B" in case that the longitudinal center line of the vehicle body 1 is not perpendicular to such surface of the building body "B".

In a similar manner to the above, it is possible for the vehicle body 1 of the apparatus of the present invention to mount the building material "A" on the interior surface of the building body "B".

What is claimed is:

1. An apparatus for transporting/mounting a building material comprising:

a self-propelled vehicle body provided with a steering/driving means, said vehicle body assuming a substantially L-shaped form constructed of an upright main body and a pair of lower frames which are parallelly spaced apart from each other and horizontally extend from opposite sides of a lower portion of said upright main body of said vehicle body;

an elevator unit movably mounted on a vertical side portion of said upright main body of said vehicle body so as to be vertically movable along said vertical side portion of said upright main body of said vehicle body;

a first frame means horizontally extending from a vertical side portion of said elevator unit, said first frame means having a base-end portion mounted on said elevator unit so as to be horizontally movable in a horizontal plane relative to said elevator unit;

a second frame means slidably mounted in said first frame means so as to be extended therefrom and retracted therein in a longitudinal direction of said first frame means; and a supporting means for supporting said building material, said supporting means being so mounted on a front-end portion of said second frame means as to be vertically swingable and as to be rotatable on an axis perpendicular to a plane in which said building material having been supported by said supporting means lies; wherein said steering/driving means of said self-propelled vehicle body is mounted substantially in a center of said lower portion of said main body of said vehicle body in a width direction thereof, and comprises:

a steering/driving wheel connected with a motor;

a front wheel rotatably mounted in a front-end portion of each of said lower frames of said vehicle body;

an inverted U-shaped bracket for supporting an axle of said steering/driving wheel and said motor connected with said axle;

a vertical shaft so provided in an upper-end surface of said inverted U-shaped bracket as to extend upward;

a supporting bracket for rotatably supporting said vertical shaft, the supporting bracket being so fixedly mounted on said main body of said vehicle body as to extend horizontally;

a pinion concentrically fixed to said vertical shaft;

a rack meshing with said pinion, said rack being movably mounted on said main body of said vehicle body; and a steering cylinder for driving said rack, the steering cylinder being fixedly mounted on said main body of said vehicle body.

2. The apparatus for transporting/mounting the building material as set forth in claim 1, wherein:

said supporting means has various kinds of clamping attachments detachably mounted thereon to make it possible to transport and mount various kinds of the building materials.

3. An apparatus for transporting/mounting the building material comprising:

a self-propelled vehicle body provided with a steering/driving means, said vehicle body assuming a substantially L-shaped form constructed of an upright main body and a pair of lower frames which are parallelly spaced apart from each other and horizontally extend from opposite sides of a lower portion of said upright main body of said vehicle body;

an elevator unit movably mounted on a vertical side portion of said upright main body of said vehicle body so as to be vertically movable along said vertical side portion of said upright main body of said vehicle body;

a first frame means horizontally extending from a vertical side portion of said elevator unit, said first frame means having a base-end portion mounted on said elevator unit so as to be horizontally movable in a horizontal plane relative to said elevator unit;

a second frame means slidably mounted in said first frame means so as to be extended therefrom and retracted therein in a longitudinal direction of said first frame means; and a supporting means for supporting said building material, said supporting means being so mounted on a front-end portion of said second frame means as to be vertically swingable and as to be rotatable on an axis perpendicular to a plane in which said building material having been supported by said supporting means lies; wherein said supporting means comprises:

an adapter plate fixedly mounted on a front-end portion of a vertical mounting plate which is mounted on a front-end portion of said second frame means through a pivot so as to be swingable in a vertical plane;

a guide ring fixedly mounted on an outer peripheral surface of a side portion of said adapter plate;

a swivel plate provided with a ring-like projection in its rear surface, said ring-like projection being rotatably mounted on an inner peripheral surface of said guide ring through a plurality of balls so as to be adjacent to a front surface of said adapter plate, said swivel plate being connected with a swivel motor fixedly mounted on said adapter plate;

a supporting plate mounted on said swivel plate through bracket means and a pivot so as to be swingable in a horizontal plane relative to said swivel plate, said bracket means being fixed to a substantially central portion of a front surface of said swivel plate, said pivot being mounted on said bracket means, said supporting plate being provided with a plurality of through-holes for supporting said building materials; and a control means for swingably driving said supporting plate in a plane perpendicular to said swivel plate so as to position said supporting plate relative to the surface of a building body.

4. The apparatus for transporting/mounting the building material as set forth in claim 3, wherein:

said control means for swingably driving said supporting plate is constructed of a pair of positioning bolts which are so fixed to said front surface of said swivel plate as to be oppositely disposed from each other in diameter of said swivel plate so as to sandwich said bracket means therebetween, said positioning bolts having their longitudinal axes oriented toward said supporting plate.

5. The apparatus for transporting/mounting the building material as set forth in claim 4, wherein:

said supporting means has various kinds of clamping attachments detachably mounted thereon to make it possible to transport and mount various kinds of the building materials.

6. The apparatus for transporting/mounting the building material as set forth in claim 3, wherein:

said supporting means has various kinds of clamping attachments detachably mounted thereon to make it possible to transport and mount various kinds of the building materials.

* * * * *